United States Patent [19]

Barclay

[11] Patent Number: 4,614,308

[45] Date of Patent: Sep. 30, 1986

[54] SHEARING MACHINE FOR REDUCING CHUNKS OF RUBBER AND LIKE MATERIAL TO SMALLER PIECES

[76] Inventor: Randel L. Barclay, 5616 Carpenter Rd., Stockton, Calif. 95205

[21] Appl. No.: 623,568

[22] Filed: Jun. 22, 1984

Related U.S. Application Data

[63] Continuation-in-part of Ser. No. 545,071, Oct. 24, 1983, abandoned, and a continuation-in-part of Ser. No. 550,919, Nov. 10, 1983, abandoned.

[51] Int. Cl.[4] ..... B02C 13/24; B02C 7/04; B02C 23/00

[52] U.S. Cl. ..... 241/154; 241/157; 241/162; 241/243; 241/257 R; 241/285 A; 241/285 B; 241/DIG. 31

[58] Field of Search ..... 241/155, 157, 158, 197, 241/243, 285 R, 285 A, 285 B, 161, 162, 154, 257 R, 258, DIG. 31

[56] References Cited

U.S. PATENT DOCUMENTS

| | | | |
|---|---|---|---|
| 48,316 | 6/1865 | Sloan . | |
| 2,063,996 | 12/1936 | Gervais | 241/155 X |
| 2,700,511 | 1/1955 | Denovan et al. | 241/154 |
| 4,374,573 | 2/1983 | Rouse et al. | 241/101.7 |

*Primary Examiner*—Howard Goldberg
*Assistant Examiner*—Timothy V. Eley
*Attorney, Agent, or Firm*—Thomas Schneck

[57] ABSTRACT

A machine of modular construction having a framework onto which a plurality of removable stators is mounted. The stators are fixed relative to rotors which fit within openings in the stators. The rotors are keyed to a central axial shaft which provides rotary power so that the rotors can rotate within the fixed stators. Each rotor has a number of radially extending blades having a forward edge carrying a knife, while the stator has similar radially extending blades and knives confronting the rotor's knives in a material shearing relationship. A modular stator is jointed for disassembly allowing access to both rotor and stator knives while the apparatus is still mounted on the framework.

12 Claims, 9 Drawing Figures

SHEARING MACHINE FOR REDUCING CHUNKS OF RUBBER AND LIKE MATERIAL TO SMALLER PIECES

CROSS REFERENCE TO RELATED APPLICATIONS

This application is a continuation-in-part of prior applications Ser. No. 545,071 filed Oct. 24, 1983 aband. and Ser. No. 550,919 filed Nov. 10, 1983 aband.

TECHNICAL FIELD

This invention relates to apparatus for reducing rubber and like material to a pellet size that has enhanced commercial value.

BACKGROUND ART

Used rubber and like resilient material from worn tires and the like has substantial utility and commercial importance. The fineness to which such material is reduced has a direct bearing on the commercial value, finer material being far more useful and valuable than relatively larger, coarser material. U.S. Pat. No. 4,374,573 discloses apparatus into which worn tires are fed to reduce the tires to shredded pieces of substantial size such as a few inches in maximum dimension.

U.S. Pat. No. 48,316 discloses a small machine for cutting and reducing vegetables. Although the machine in the '316 patent bears certain superficial similarities to the present apparatus, it is unsatisfactory for reducing rubber and like resilient material, and in order to repair or maintain it, full disassembly is necessary.

SUMMARY OF THE INVENTION

An object of the invention is to provide apparatus for reducing shredded rubber and the like to pellet size. This object is achieved by providing plural stators and plural rotors which subject each piece or chunk traversing the apparatus to multiple shearing cuts. These stators and rotors have been toughened for handling tough material, such as steel reinforced rubber, yet are fashioned in modular construction for ease of maintenance.

In the specific embodiment of the invention that is shown and described more fully hereinafter there is a plurality of bladed stators and an equal plurality of bladed rotors which are rotatively driven within the stators so that the fixed blades and the moving blades coact to shear rubber chunks and pieces into relatively fine pellets. The apparatus is arranged in a vertical orientation so that the pellets gravitate through the coacting blade sets.

In the interests of economy of manufacturing and maintenance the stators are identical and grouped about an axial shaft so that the blades in respective stators are vertically aligned with one another. The rotor blades, however, are offset with respect to one another to avoid any unimpeded passageway vertically through the apparatus which would permit large chunks of material to traverse the apparatus without being reduced and to avoid overloads.

The shaft is driven by a motor or engine that can deliver 400 horsepower or more. Consequently the parts of the apparatus are subjected to substantial forces and the material shearing blades in the apparatus are subjected to abrasion and wear due to the nature of the rubber material processed by the apparatus. To achieve the object of rapid and relatively inexpensive maintenance the stators are supported in a frame partly defined by two cylindrically shaped tension standards on which the stators are mounted, each individual stator being formed by a pair of identical generally semicircular members, each of which has a circular opening for fitting onto one of the tension standards. In the operating condition, the two stator halves are bolted together to form a unitary stator. When replacement or maintenance of one of the stators is required, however, the bolts can be removed and each half can be pivoted outwardly so that needed maintenance can be performed. The stators are provided with replacement knives which can be changed in this position without total disssembly of the apparatus.

The foregoing, together with other objects, features and advantages, will be more apparent after referring to the following specification and the accompanying drawings.

BEST MODE FOR CARRYING OUT THE INVENTION

Figure 1:
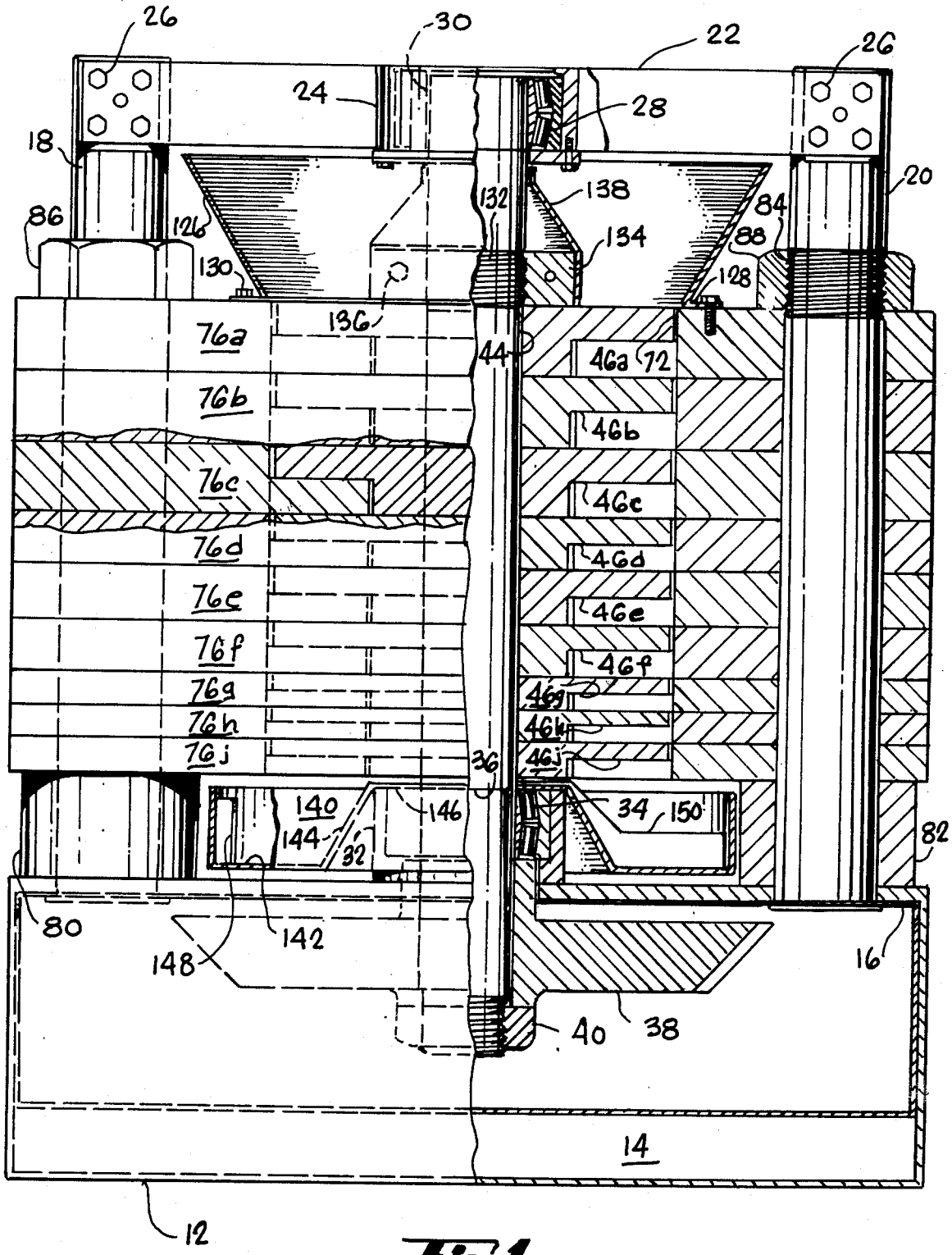
FIG. 1 is an elevation view in partial cross section of one embodiment of the invention.

With reference to FIG. 1, rigid base 12 for supporting the apparatus is of hollow construction to define an internal chamber 14. Base 12 has a top plate 16 to which tension standards 18 and 20 are fixed. The tension standards extend upward from base 12 in vertical orientation and are spaced apart from one another to form a central space in which the remainder of the apparatus is disposed.

Spanning the top extremities of tension members 18 and 20 is a crossbar 22 which affords rigidity to the tension standards and supports an upper bearing housing 24. The top extremities of tension members 18 and 20 define flat chordally extending surfaces which contain a pattern of tapped holes in which crossbar mounting bolts 26 can be engaged. Each end of the crossbar is provided with an array of correspondingly positioned holes through which bolts 26 extend to retain the crossbar onto the tension standards in a secure but removable manner.

Bearing housing 24 supports the outer race of a roller bearing 28, in the inner race of which the top end of a main drive shaft 30 is supported. In axial alignment with upper bearing housing 24 is a lower bearing housing 32 which is fixed to top plate 16 of base 12. Supported in bearing housing 32 is a roller bearing 34 which supports the lower end of main shaft 30. Main shaft 30 is formed with an annular shoulder 36 which cooperates with an inner race of bearing 34 to establish the vertical position of the main shaft. The lower end of drive shaft 30 extends below top plate 16 of the base; a beveled drive gear 38 is secured to the protruding portion of the shaft by any suitable expedient, such as by a nut 40. A motor driven bevel gear, or a number of gears, not shown, meshes with bevel gear 38 at right angles to impart torque to drive shaft 30.

The advantage to using several input bevel gears is that a number of lower horsepower motors can be used. Rather than using a single 600 horsepower motor feeding power through a reduction gear box to a single bevel gear at right angles to bevel gear 38, four bevel gears, each connected to a 150 horsepower motor can be used. Overrunning clutches couple power from the motors to the bevel gear.

Figure 3:
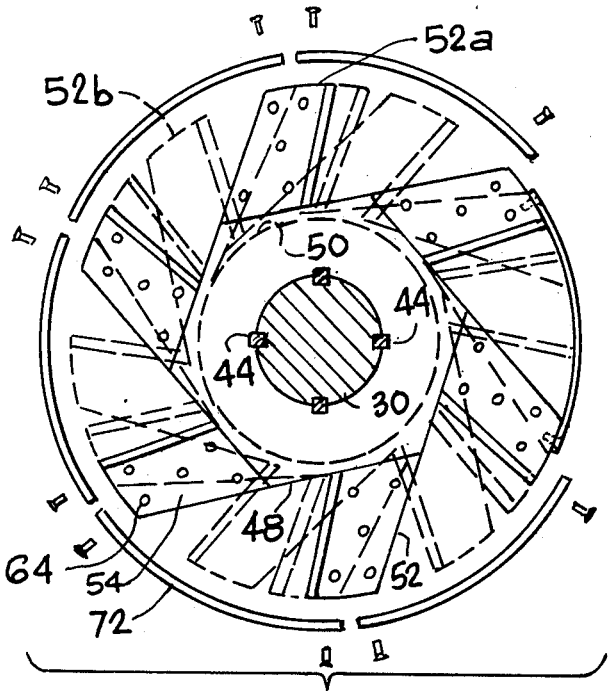
FIG. 3 is a top view of a rotor.
Figure 5:
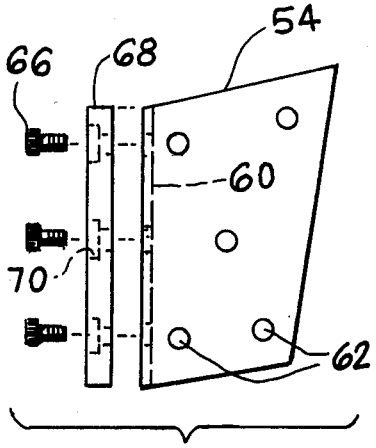
FIG. 5 is an exploded view of a knife blade subassembly adapted to be mounted on the leading surfaces of the rotor blades.

Shaft 30 is formed with one or more keyways for receiving keys 44, more visible in FIG. 3. It is preferred that four keyways and keys be provided on shaft 30 in quadrature as shown in FIG. 5. There is a plurality of rotors identified at 46*a*, 46*b*, 46*c*, 46*d*, 46*e*, 46*f*, 46*g*, 46*h* and 46*j* mounted on shaft 30.

Figure 2:
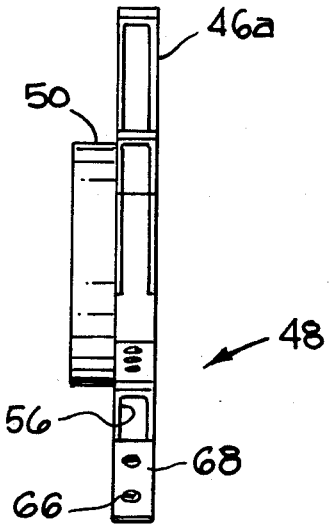
FIG. 2 is a side view of a rotor in accord with the present invention.
Figure 6:
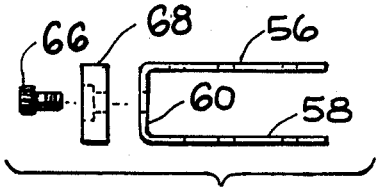
FIG. 6 is a bottom view of the knife blade subassembly of FIG. 8.
Figure 4:
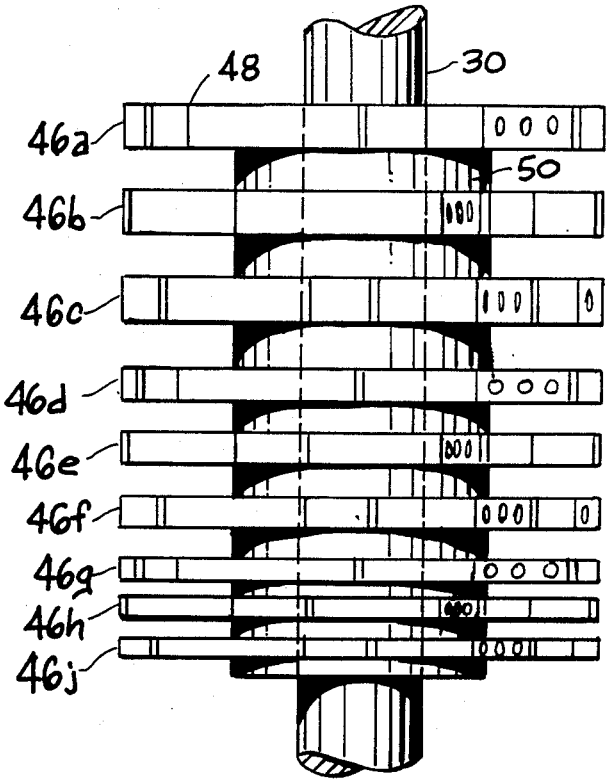
FIG. 4 is an elevation view of a rotor assembly shown in absence of stators.

Referring to FIGS. 2–4, each rotor includes a cutter body portion 48 and an integral hub 50. As seen most clearly in FIG. 3, the cutter body includes six radiating blades 52 which are uniformly spaced around the center thereof. The leading edges of the blades are slightly oblique of a radial line from the center of shaft 30 with the innermost portion of the edge trailing the outermost portion. Obliqueness in the stated direction coacts with centrifugal force on rubber chunks to cause the chunks to tumble and then to be reduced more efficiently. In one apparatus designed in accordance with the invention the forward or leading edge of blade body 52 resides at an angle of about ten degrees from a radial of shaft 30. Fixed to each blade 52 is a cutting knife structure seen most clearly in FIGS. 5 and 6. The cutting knife structure includes a steel wear shoe mounting member 54 of generally U-shaped configuration and uniform thickness, about one-quarter inch, having an upper plate 56, a lower plate 58 and a web 60 extending between the two plates. Each wear shoe protects sides of each blade, as well as providing a protected edge where a knife can be mounted. The upper and lower plates are formed with arrays of registered holes 62, and blade 52 or rotor 46*a* has similarly positioned holes. Bolts 64 fix the plates to the respective blades with web 60 being substantially coextensive with the leading edge of blade 52. The web 60 defines three or more uniformly spaced-apart tapped holes to receive mounting bolts 66 therein. The mounting bolts serve to fix to web 60 a knife blade 68 which is formed of high strength, abrasion resistant material such as carbide, tungsten steel or the like. Knife 68 is formed with counter bores 70 so as to receive the heads of bolts 66 therein so that the heads are flush. As is clear from FIG. 3, each of the six blades 52 is equipped with a knife mounting member or wear shoe 54.

The outer radial extremities or circumferential surfaces of each of blades 52 is of arcuate configuration. Each circumferential surface is formed with at least two radially extending tapped holes for receiving mounting screws that mount a steel ring segment 72. Each ring segment 72 has a circumferential extent of approximately 60 degrees, because in the embodiment shown, there are six blades 52. Thus the entire rotor is defined at its exterior by a continuous ring formed of ring segments 72. For clarity the ring segments are not shown in FIGS. 4 and 6. The ring formed by ring segments 72 resists outward movement of rubber chunks in response to centrifugal force and promotes gravitation of the particles through the apparatus, as well as protecting edges of the blades.

The preceding description of rotor 46*a* is typical of the other rotors, 46*b*–46*j*, seen in FIG. 1, except that there are rotors of three sizes, the rotors at the top being relatively thick, i.e. having a relatively large axial dimension, the center three rotars being somewht thinner and the lowermost rotors being still thinner. The larger dimensioned rotors are stronger for handling larger pieces of material. The smaller rotors, located near the bottom, handle smaller pieces and therefore do not need the same degree of strength.

There is an equal number of stators provided in the apparatus for coaction with the rotors described above. More specifically there are stators 76*a*, 76*b*, 76*c*, 76*d*, 76*e*, 76*f*, 76*g*, 76*h*, and 76*j*. The stators have a vertical extent corresponding to the associated rotors, as can be seen most clearly in FIG. 1. Also seen in FIG. 1 is the fact that the stators are supported in the apparatus atop spacers 80 and 82, which are of generally cylindrical form and define central bores for receiving tension standards 18 and 20 therethrough. Stators 76*a*–76*j* are stacked on the upper surface of the spacers. In alignment with the top of the stator, stack tension standards 18 and 20 define threaded portions 84 with which compression nuts 86 and 88 are engaged for fixing the stators rigidly to base 12.

Figure 7:
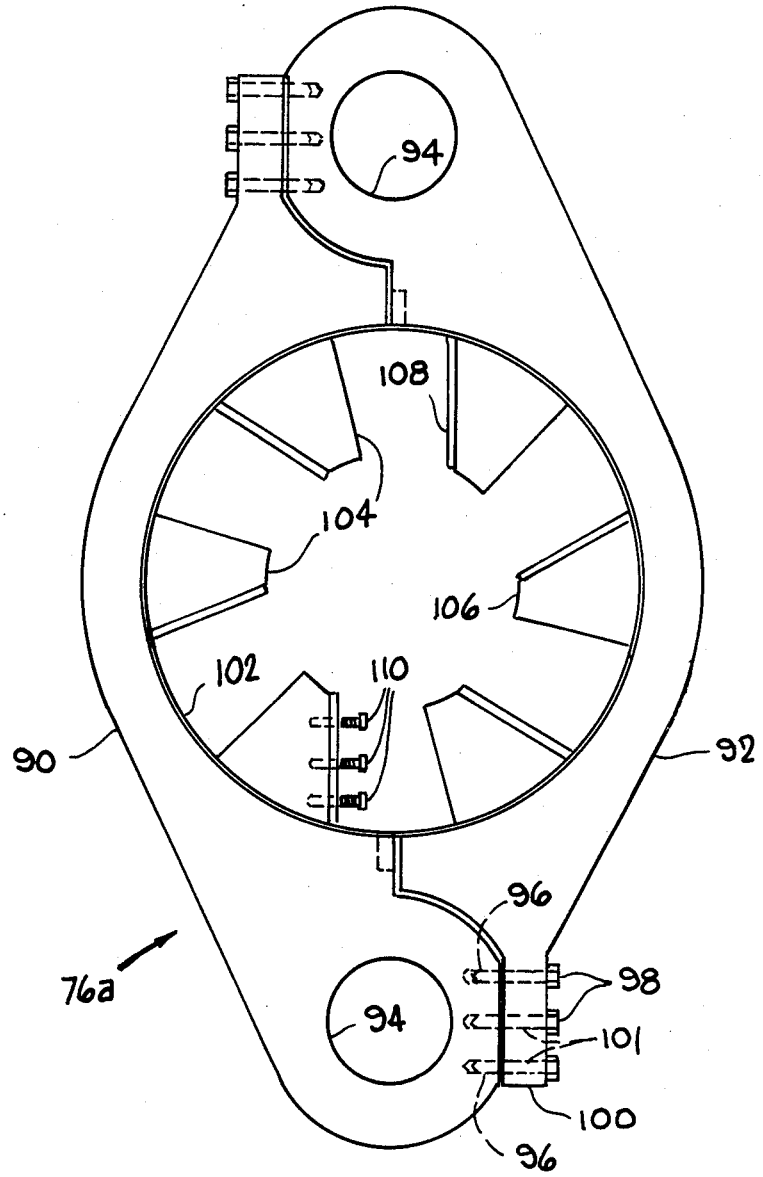
FIG. 7 is a cross-sectional view of an assembled stator with the coacting rotor removed.
Figure 8:
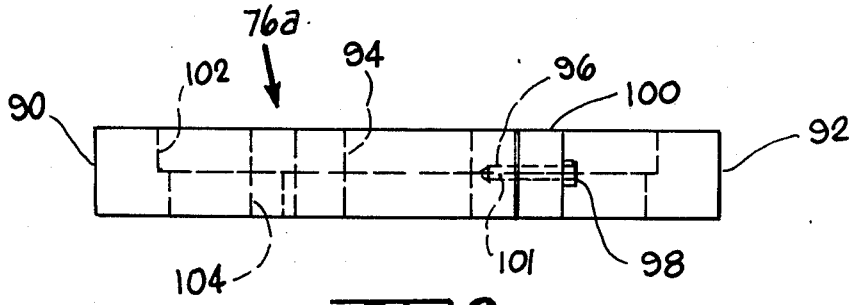
FIG. 8 is a bottom view of the assembly of FIG. 7.

Stator 76*a*, seen in substantial detail in FIGS. 7 and 8, is exemplary of all stators and a description of it will suffice as a detailed description of all stators. The stator is composed of two substantially identical halves 90 and 92. Each half defines a cylindric bore 94 which is sized to receive tension standards 18, 20. Adjacent to bores 94, each half is provided with one or more tapped holes 96 for receiving bolts 98 therein. Each stator half opposite from bore 94 has a projection 100 that defines holes 101 equal in number and relative spacing to threaded holes 96. Holes 101 are sized for clearance of bolts 98 so that the bolts can be passed through the holes and engaged in threaded holes 96, thereby retaining the two halves of the stator in a unitary assembly.

Stator 76*a* defines a central cylindric opening 102 which has a diameter slightly larger than the outside diameter of the rotors when ring segments 72 are in place. This permits the rotors to rotate freely within opening 102. The axial extent of opening 102 corresponds to the axial extent of body portion 48 of the stator so that the stators and rotors can assume the assembled condition seen in FIG. 1. Projecting radially inward from the lower portion of central opening 102 is a plurality of blades 104. In the embodiment shown, the blades are six in number and are circumferentially dimensioned such that the circumferential extent of each fixed blade roughly corresponds to the space between adjacent fixed blades. Blades 104 have an axial extent substantially equal to that of rotor hub 50; the inner radial extremity of each blade is formed with an arcuate surface 106 which lies on an imaginary cylinder surface concentric with cylinder opening 102, so that hub 50 of the rotors can freely rotate within opening 102 without creation of a substantial gap between the periphery of the rotor and blade surfaces 106.

The edges of fixed blades 104 that confront rotor knives 68, when the rotor revolves, are provided with knives 108 which are formed of hard abrasion resistant material. Each knife 108 is formed with a row of counter bored holes to receive mounting bolts 110 therein.

Figure 9:
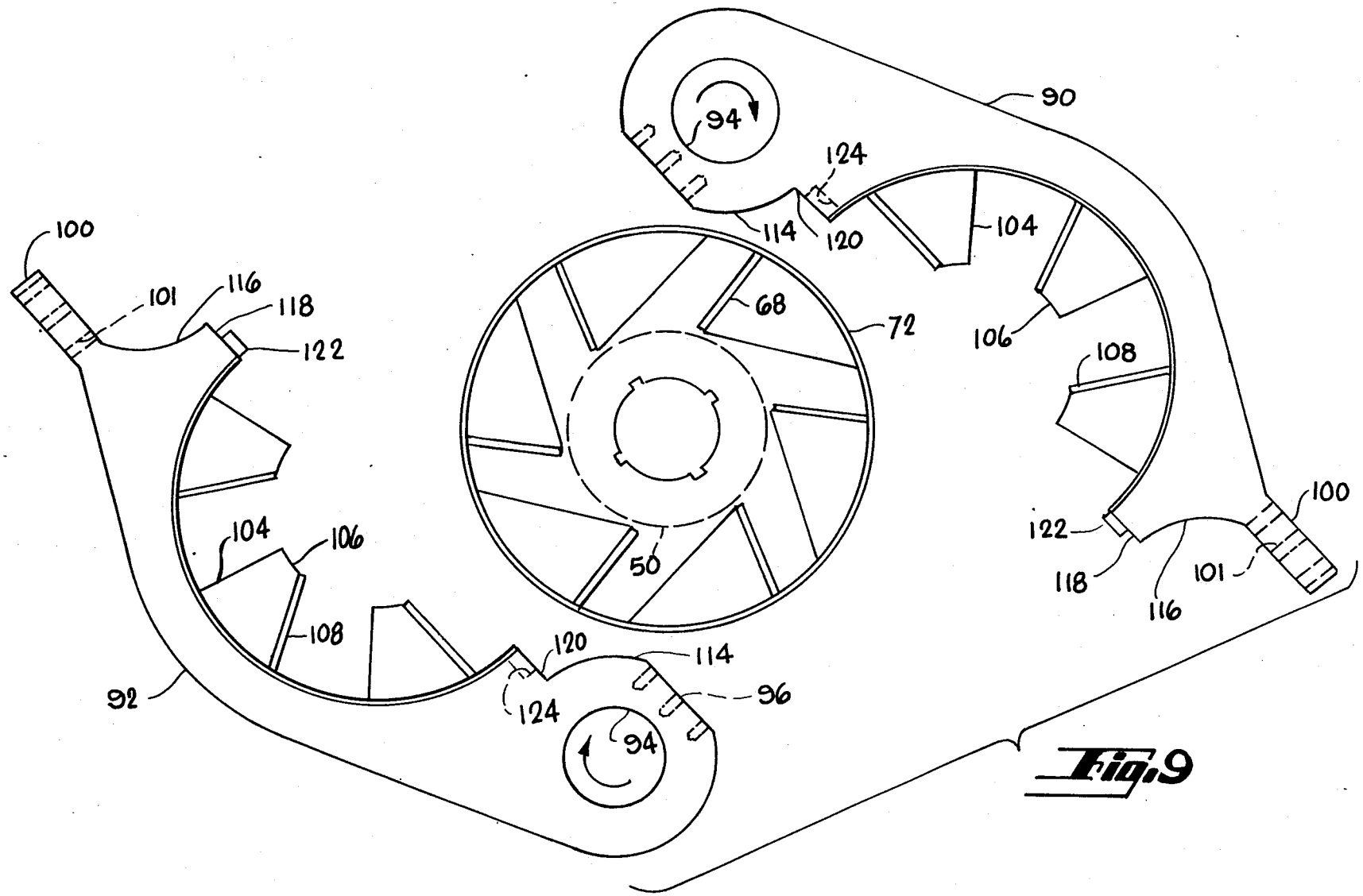
FIG. 9 is a view of two stator halves pivoted outwardly to a position to afford access to the internal parts of the stator.

The configuration of stator halves 90 and 92 can be seen more clearly in FIG. 9. Each stator half has an arcuate convex surface 114 that is substantially concentric with the wall of bore 94. At the opposite extremity of the stator half there is a congruent concave arcuate portion 116 so that then the two halves are asembled to the condition seen in FIG. 7, convex surfaces 114 nest with concave surfaces 116 to enhance the rigidity of the assembled structure and to avoid creation of spaces in which rubber particles might accumulate. Each half also defines diametrically opposite flat radially extending surfaces which contact one another when the two halves are assembled. Adjacent concave surface 116 is a radially extending flat surface 118, and adjacent convex surface 114 is a radially extending flat surface 120. Projecting outwardly from surface 118 is an alignment key 122; formed in each half in communication with surface 120 is a complementally shaped keyway 124 which is sized and shaped to receive key 122 of the opposite half. Thus when the two halves are in the assembled condition, they are rigidly supported with respect to one another and are configured so as to avoid creation of spaces in which reduced material might accumulate.

Fixed to the uppermost surface of the uppermost stator 76*a* is an inlet guide chute 126. As seen in FIG. 1 chute 126 is of inverted frustoconical form and has a lower opening approximating the diameter of circular opening 102 in the stators. From its lower extremity chute 126 diverges upward so as to facilitate introduction of rubber pieces and chunks to the apparatus. Surrounding the exterior of the lower extremity of the chute is a mounting flange 126 which defines a series of holes for receiving chute mounting screws 130 therethrough, the upper surface of stator 76*a* being provided with correspondingly positioned tapped holes to receive screws and afford secure attachment of the chute in place.

For firmly securing rotors 46*a*–46*j* to shaft 30 against axial movement, the shaft is provided with a threaded region 132, adjacent its upper extremity, with which is engaged a nut 134. Nut 134 preferably has a square shape and is split along a diametrically extending plane perpendicular to the flat sides of the nut. The two halves of the nut are formed with aligned clearance and tapped holes for receiving clamp bolts, one of which is seen at 136. Clamp bolts 136 can be tightened until the appropriate rotational position of nut 136 is established and then can be tightened so as to secure the nut immovably with respect to thread 132 and shaft 30. Overlying nut 136 is sheet metal shroud 138 which has a frustoconical surface that diverges downward so as to exclude material from nut 134 and to cooperate with chute 126 in guiding the material into the active region of the apparatus.

At the lower end of the shaft and fixed to bearing housing 32 there is a discharge receptacle having a cylindrical side wall 140 and a bottom annular wall 142 which are integral with one another and formed of sheet metal or like rigid impervious material. At the inner extremity of bottom annular wall 142 is an upward converging sloped wall 144 which terminates in a horizontally extending annular wall 146 that overlies bearing 34 and excludes reduced material, usually of pellet size, therefrom. Side wall 140 of the discharge receptacle defines at least one discharge opening 148 through which pellet-size matter is discharged after it has been processed by the apparatus of the invention. Supported to the lower surface of rotor 46*j* is a distribution paddle 150 which revolves with the rotor and sweeps particulate matter received in the receptacle circularly in the receptacle so that the particulate matter can be discharged through discharge opening 148. As can be seen in FIG. 1, distribution paddle 150 has a lower surface congruent to the inner surface of the discharge receptacle and discharge opening 148 extends to bottom annular wall 142 of the discharge so that in response to rotation of the rotor and the paddle, particulate matter is discharged.

In operation, the rotor is first powered up and rubber pieces or the like are introduced into inlet chute 126. The downward converging wall of the inlet chute directs each piece, falling under the influence of gravity, between blades 52 of rotor 46*a*. Because of the shearing action between knives 68 on the rotor and knives 108 on the stator, relatively small pieces of material are sheared from the relatively larger pieces introduced to the inlet chute. Such relatively small pieces gravitate through the spaces between successive rotor-stator pairs and are repetitively subject to shearing action between the rotor and stator knives. The thickness of each rotor-stator pair decreases as the pieces of material gravitate downward in the apparatus so that each particle is subjected to successive shear passes until the particles, now small in size, drop into the discharge receptacle. Such outlet size pieces are swept in a circular motion within the discharge receptacle by paddle 150 and are discharged through discharge opening 148 for subsequent travel in commerce.

Blades 52 of adjacent rotors are rotationally offset from one another so as to prevent passage of a rubber particle through the apparatus without exposure to numerous shearing strokes. In particular reference to FIG. 3 a blade on upper rotor 46*a* is indicated at 52*a*. A blade on rotor 46*b* is shown in broken lines 52*b*, the blade residing between two adjacent blades 52*a* thus to inhibit movement of particles through the apparatus without being subjected to plural shearing passes by the knives. Also shown in FIG. 3, in broken lines, is another blade position approximately ten degrees from that occupied by blade 52*a*.

The blades are offset from one level to the next so that overlying blades are not in the same position. While one blade set is cutting, another is finishing and yet another is just about to start. This alignment prevents thumping and overloading of the motors.

The segmented construction of the stators facilitates initial assembly of the apparatus as well as disassembly of the apparatus for maintenance. More specifically, respective stator segment halves can be placed on respective tension standards 18 and 20 after which nuts 86 and 88 can be engaged with threads 84 and tightened to a finger-tight position. With the stator halves pivoted to an outward position as shown in FIG. 9, the entire rotor assembly can be introduced into the apparatus until shaft shoulder 36 contacts the inner race of roller bearing 34. Nut 134 shown in FIG. 1, can be fully tightened before such introduction and shroud 138 can be installed. Next, inlet chute 126 is positioned on top of the apparatus but not fastened and crossbar 22 along with bearing 28 is installed. The tightening of nuts 26 not only fixes the crossbar in place but lends significant rigidity to tension standards 18 and 20. Then bevel gear 38 can be installed and retained in place by nut 40. With the rotor assembly in position as described above, the stator halves can be pivoted inward until their confronting surfaces mate with one another. Bolts 98 are then installed and tightened, as are nuts 86 and 88, shown in FIG. 1, and the apparatus is ready for use after a driving bevel gear is installed in mesh with bevel gear 38.

Knives 68 and 108 sustain most of the wear in the apparatus and they can be replaced without complete disassembly. More specifically, bolts 94 can be removed so that the various stator halves can be pivoted outward. With the stator halves pivoted outward, knives 108 on the stator blades can be replaced. In addition, because bolts 66 that maintain rotor knives 68 in place are accessible when the stator halves are pivoted outward, the rotor knives can likewise be replaced.

The exemplary apparatus is massive and is driven by a 150 horsepower prime mover at a speed of about 10 rpm. Tension standards 18 and 20 and shaft 30 each have a diameter of 12 inches. Rotors **76*a*–76*j* have a diameter of about 48 inches and the central openings of the stators have a corresponding diameter. Stators 76*a*–76*c* each have a vertical extend of eight inches, stators 76*d*–76*h* each have a vertical extent of six inches and stators 76*g*–76*j*** each have a vertical extent of four inches. Thus, the height of the active part of the apparatus is four and one-half feet. Such apparatus is capable of reducing relatively large rubber pieces and chunks into small pellet sizes, less than one-half inch in dimension, which have a much greater commercial value than the large pieces.

Thus it will be seen that the invention provides reducing apparatus which is efficient in reducing the size of rubber particles and the like which is uncomplex in construction and which can be serviced or maintained with great facility.

I claim:

1. A shearing machine for reducing chunks of tough material, such as rubber, to relatively small size pellets comprising, a framework defined by a plurality of fixed members, a plurality of stators mounted on the framework, the stators having openings and a plurality of blades having planar, spaced-apart plates on opposite sides of the blades, extending radially inwardly into said openings toward a central region, the blades having a forward edge with a knife connected thereto, a central axial shaft extending through the central region of the stators, a plurality of rotors corresponding in number to the stators, each rotor fitting within the opening of a stator and having a central hub connected to said axial shaft, each rotor having a plurality of blades having planar, spaced-apart plates on opposite sides of the blades extending radially outwardly confronting the blades of the stator, a plate of a stator blade clearing an adjacent plate of a rotor blade in a material shearing relationship, and motor means in power transfer relation to said central axis shaft for enabling shearing of material at least as tough as chunks of rubber between adjacent rotor and stator blade plates, said motor means rotating said blades at a rate of less than 100 revolutions per minute.

2. Apparatus according to claim 1 wherein said shaft has opposed ends, with a material inflow port at one end of the shaft and a material outflow port at an opposite end of the shaft, the axial dimension of the stators and rotors varying along the shaft with a larger dimension near the material inflow port and a smaller dimension near the material outflow port.

3. Apparatus according to claim 1 wherein said stators include a joint means for disassembly of the stators while still connected to the framework, the joint allowing access to the knives of said stator and to the knives of a rotor within the stator.

4. Apparatus according to claim 1 wherein the framework includes a pair of fixed, parallel, spaced-apart tension standards, said stators having oppositely spaced holes through which said tension standards pass.

5. Apparatus according to claim 1 wherein blades of one rotor are angularly offset from blades of a neighboring rotor for blocking axial passage of material without shearing.

6. Apparatus according to claim 1 wherein an arcuate ring segment is disposed joining radially outward blade edges of said rotors.

7. A shearing machine for reducing chunks of tough material, such as rubber, to relatively small size pellets comprising, a plurality of stator bodies each having an inner cylindric wall that defines a cylindric opening, a plurality of stator blades fixed to said wall and extending radially inward from one axial extremity of said wall, said stator blades being circumferentially spaced apart by an amount so as to form spaces between adjacent said stator blades, said stator blades having inner extremities that are arcuately configured and reside on an imaginary cylinder concentric with said cylindric wall to form a clearance opening, said stator blades having planar, spaced-apart opposite plates, means for supporting said stators in a stack so that the cylindric openings and clearance openings of all said stators are disposed in aligned vertical relation, a drive shaft supported for rotation within and concentric of said stator clearance opening, a plurality of rotors fixed to said drive shaft, each said rotor having a central hub sized for running within said clearance opening and having an axial extent corresponding to the axial extent of said stator blades, a plurality of rotor blades rigid with and projecting radially outward of said rotor hub, said rotor blades being circumferentially spaced apart by an amount so as to form open spaces between adjacent said rotor blades, at least some of said blades being rotationally offset relative to other blades so as to avoid establishment of unobstructed vertical passages through said apparatus irrespective of the rotational position of said shaft, said rotor blades having planar, spaced-apart plates on opposite sides of the blades, a plate of a stator blade clearing an adjacent plate of a rotor blade in a material shearing relation, and means for rotatively driving said drive shaft so as to rotate said rotor blades relative to said stator blades and to effect shearing of said body of tough material at a rate of less than 100 revolutions per minute.

8. Apparatus according to claim 7 wherein each said rotor blade has a leading edge and a trailing edge and wherein said driving means rotates said rotors such that the leading edge traverses said stator blades ahead of said trailing edge, said leading edge being oblique of a radial line from the center of the shaft, the portion of said leading edge remote from said shaft leading the portion of said leading edge adjacent said shaft so as to counter outward movement of rubber particles due to centrifugal force.

9. Apparatus according to claim 7 including a plurality of rigid ring segments secured to the radial extremities of said rotor blades, said ring segments forming in their totality a ring circumscribing said rotor in substantial concentricity with said shaft so as to confine particles within the space bounded by said rotor blades and said ring segments.

10. Apparatus according to claim 7 including a plurality of rotor knives, one of which is fastened to the leading edge of each said rotor blade and a plurality of stator knives, one of which is fastened to the leading edge of each said stator blade, said knives being formed of hard abrasion-resistant material.

11. Apparatus according to claim 10 including means for removably attaching said knives to respective said blades to facilitate replacement of said knives.

12. Apparatus according to claim 7 wherein said stator supporting means comprises a base and first and second tension standards extending upward from said base in vertical spaced-apart relation, each said stator having two substantially identical stator halves, each stator defining an opening for engagement on one of said tension standards, said stator halves being complementally nestable in an operating position and being pivotable with respect to said tension standards to a retracted position and means for removably securing said stator halves in said operating position.

* * * * *

UNITED STATES PATENT AND TRADEMARK OFFICE

CERTIFICATE OF CORRECTION

PATENT NO. : 4,614,308

DATED : September 30, 1986

INVENTOR(S) : Randel L. Barclay

It is certified that error appears in the above-identified patent and that said Letters Patent are hereby corrected as shown below:

Column 2, lines 11-12, the words "The stators are provided with replacement knives" should read - -The stators are provided with replaceable knives- -.

Column 3, line 20, the words "FIG. 5" should read - -FIG. 3- -.

Column 5, line 35, the words "mounting flange 126" should read - -mounting flange 128- -.

Claim 1, lines 60-61, the words "central axis shaft for enabling shearing" should read - -central axial shaft for enabling shearing- -.

Signed and Sealed this

Sixteenth Day of December, 1986

*Attest:*

DONALD J. QUIGG

*Attesting Officer* *Commissioner of Patents and Trademarks*